US006507956B1

(12) United States Patent
Kronenbeger

(10) Patent No.: US 6,507,956 B1
(45) Date of Patent: Jan. 21, 2003

(54) HEADWEAR PACKAGING SYSTEM

(76) Inventor: Ronald Kronenbeger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 09/723,030

(22) Filed: Nov. 27, 2000

(51) Int. Cl.[7] ..... A42B 1/00
(52) U.S. Cl. ..... 2/195.1; 2/209.13
(58) Field of Search ..... 2/195.1, 195.6, 2/209.11, 209.13, 175.1, 175.4, 195.5, 171.03; 211/85.3; 224/251, 933; 40/329

(56) References Cited

U.S. PATENT DOCUMENTS 2,864,092 A * 12/1958 Hurst ..... 2/195.1
4,821,341 A * 4/1989 Baptiste ..... 2/10
5,862,522 A * 1/1999 Cho ..... 2/195.1
5,903,921 A * 5/1999 Dow ..... 2/12
5,991,927 A * 11/1999 Barbaccia ..... 2/209.13
6,059,246 A * 5/2000 Robbins ..... 248/317
6,138,279 A * 10/2000 Gore ..... 2/175.5
6,311,331 B1 * 11/2001 Park ..... 2/195.1
6,317,892 B1 * 11/2001 Galigani ..... 2/209.11

OTHER PUBLICATIONS

Photographs of American Needle's "The Bucket" headwear and packaging.

* cited by examiner

*Primary Examiner*—John J. Calvert
*Assistant Examiner*—Katherine Moran
(74) *Attorney, Agent, or Firm*—Wood, Phillips, Katz, Clark & Mortimer

(57) ABSTRACT

The combination of a headwear piece and at least one holding element. The headwear piece has a front and rear and consists of a crown with a surface which is grippingly engageable with a wearer's head and a visor projecting in a forward direction away from the crown. The visor has a relaxed state, wherein the visor has a first width dimension taken transversely to a fore-and-aft line, and a deformed state. With the visor in the deformed state, the visor has a second width dimension that is less than the first width dimension. The at least one holding element maintains the visor in the deformed state in which the visor has the second width dimension.

30 Claims, 3 Drawing Sheets

HEADWEAR PACKAGING SYSTEM

BACKGROUND OF THE INVENTION

1. Field of the Invention

This invention relates to headwear and, more particularly, to a system wherein a headwear piece is displayed in a state wherein it is deformed from a relaxed state in which it is normally worn.

2. Background Art

Headwear in the form of baseball-style caps and visors is becoming increasingly popular. This headwear is used in both business and recreational settings. The visor and baseball-style cap configurations lend themselves to the application of information on both a crown and a visor projecting therefrom. The information that can be applied thereto is virtually limitless in nature and, as an example, may be related to a business, a product, a team, a school sport, a location, etc.

Aside from the informational aspect of this headwear, it is also desirable for its design characteristics. Many variations of the baseball-style cap are currently offered with a multitude of designs which range from basic to flamboyant. Aside from its appearance, this headwear lends itself to being worn in different manners, i.e., with the visor projecting forwardly, rearwardly, and to either side.

Still further, this type of headwear is desirable from the standpoint of comfort. The headwear can be made from lightweight fabric that shields its wearer from sun and rain, yet which is comfortable to wear from the standpoint of fit. Additionally, the headwear can be made from materials that vary as to potentially be more comfortable in both warm and cold atmospheres.

The proliferation of this type of headwear has prompted purveyors thereof to seek new ways to market so that their product stands out amongst the myriad headwear pieces available. It is common to display this type of headwear in a hanging position with the visor angled downwardly so that a prospective customer can view the majority of the adorned surfaces thereof. In some sporting good stores, entire walls may be covered with this type of headwear. While this type of display is effective, the individual headwear pieces tend to blend into the sea of headwear pieces that are displayed. As a result, the unique appearance of a headwear piece may not be appreciated.

It is also common to display this type of headwear on shelves laid flat on an upwardly facing, horizontally oriented shelf surface. With many headwear pieces being displayed, the unique appearance of a particular headwear piece may not be appreciated.

The headwear industry is constantly seeking ways to highlight products that are unique in both function and appearance.

SUMMARY OF THE INVENTION

In one form, the invention is directed to the combination of a headwear piece and at least one holding element. The headwear piece has a front and rear and consists of a crown with a surface which is grippingly engageable with a wearer's head and a visor projecting in a forward direction away from the crown. The visor has a relaxed state, wherein the visor has a first width dimension taken transversely to a fore-and-aft line, and a deformed state. With the visor in the deformed state, the visor has a second width dimension that is less than the first width dimension. The at least one holding element maintains the visor in the deformed state in which the visor has the second width dimension.

The at least one holding element may be a continuous band which extends around the headwear piece.

In one form, the at least one holding element is a band which has first and second parts which are joinable to extend around the headwear piece. The band may be made from a string material.

In one form, the at least one holding element is a tubular body which extends around the headwear piece.

The at least one holding element may be a cylindrical tube. In one form, the cylindrical tube defines a storage space for the headwear piece and has an open end through which the headwear piece can be introduced into the storage space and removed from the storage space. A removable cap selectively blocks the open end.

The cylindrical tube has a peripheral wall. In one form, the headwear piece in the storage space can be viewed through the peripheral wall.

In one form, the visor is defined by a foam layer.

With the visor in the deformed state, the visor may define a cylindrical shape.

In the deformed state, the visor may be doubled against itself to extend through 360°.

In one form, the crown is folded against itself. The crown may be additionally folded against the visor.

In another form, the crown is folded against the visor.

In one form, the visor in the deformed state defines a cylindrical shape and at least a part of the crown resides within the cylindrical shape.

In one form, the crown has a closed, cup shape.

The crown may have a head engaging portion extending through 360°.

In another form, the crown has a head engaging portion which extends through less than 360°.

In another form, the invention is directed to the combination of a headwear piece and at least one holding element. The headwear piece has a crown with a surface which is grippingly engageable with a wearer's head and a visor projecting from the crown. The visor has a deformed state wherein the visor is formed into a cylindrical shape. The at least one holding element maintains the visor in the deformed state.

In one form, with the visor in the deformed state, the cylindrical shape extends through 360°.

The visor may be formed from a foam layer.

In one form, the at least one holding element extends through 360° around the headwear piece.

DETAILED DESCRIPTION OF THE DRAWINGS

Figure 1:
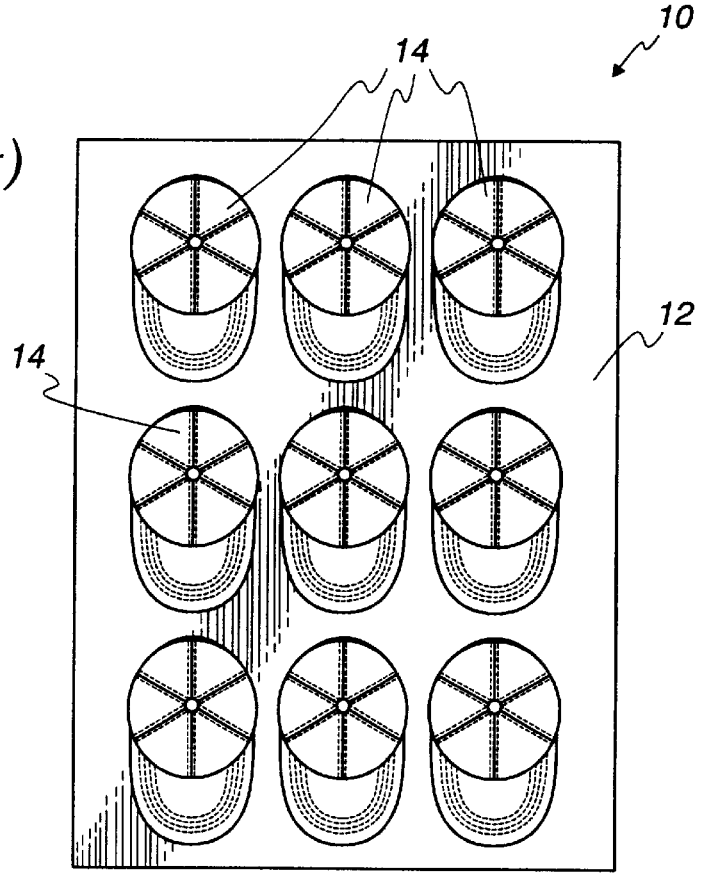
Fig. 1 (Prior Art)
FIG. 1 is a front elevation view of a conventional type of display for a plurality of baseball-style headwear pieces.

In FIG. 1, a conventional headwear display is shown at 10 and consists of a vertically extending wall surface 12 to which individual pieces of headwear 14 are mounted in a display state. The wall surface 12 may have hooks or other types of hangers (not shown) from which the headwear pieces 14 can be suspended. The hangers are located so that a relatively large number of the headwear pieces 14 can be displayed on the wall surface 12.

In FIGS. 2–7, one form of displaying a headwear piece 16, according to the present invention, is shown. The headwear piece 16 is a conventional baseball-style cap consisting of an inverted, cup-shaped crown 18 having a front 20 and rear 22. A visor 24 projects angularly forwardly from the crown 18. The crown 18 has an internal surface 26 which is grippingly engageable with a wearer's head directed into the crown 18.

Figure 2:
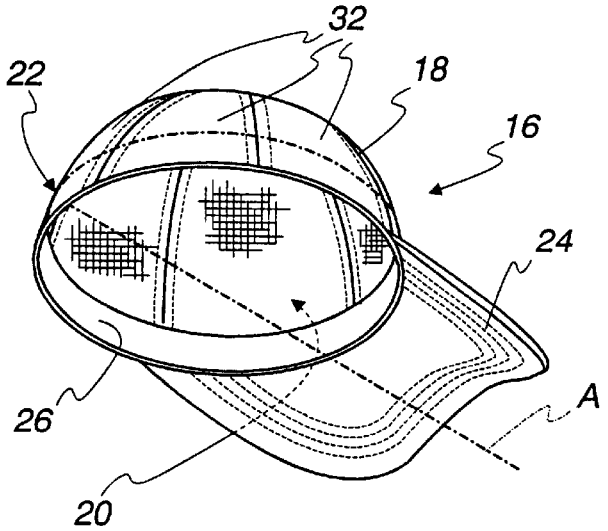
FIG. 2 is a bottom perspective view of a headwear piece with which the present invention can be practiced and consisting of a crown and a visor projecting from the crown.
Figure 3:
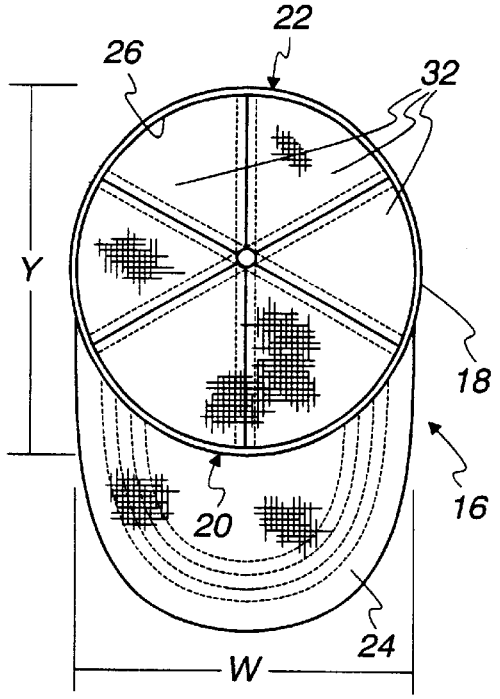
FIG. 3 is a bottom view of the headwear piece in FIG. 2.
Figure 4:
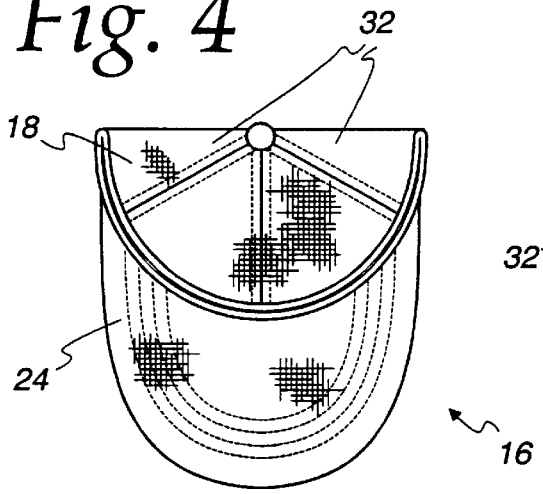
FIG. 4 is a view as in FIG. 3 with the crown folded in a forward direction against itself.

In FIGS. 2–4, the crown 18 is shown in a relaxed state, in which it is normally worn, and wherein it has a width W. The visor 24 may be made from a single layer or multiple layers. In a preferred form, the visor includes at least one foam layer 28, as described in detail in U.S. Pat. No. 6,076,192, entitled "Headwear Piece With Projecting Bill", which is incorporated herein by reference. The foam layer 28 may be optionally covered by a skin 30, as also described in U.S. Pat. No. 6,076,192. Accordingly, the visor 24 can be made with sufficient memory so that it can be deformed and will substantially assume its relaxed state once the deforming force is removed.

The crown 18 is generally made from fabric gores 32 which are triangular in shape and sewn edge-to-edge to produce the inverted, cup-shaped configuration shown in the Figures. Generally, the fabric defining the crown 18 is quite flexible so as to allow the crown 18 to be folded randomly and collapsed to a relatively compact state. The visor 24 generally is more rigid than the crown 18.

According to the invention, the visor 24 is reconfigured to a deformed state which reduces its width (W1) from that (W) in the relaxed state to facilitate display in a more compact state. As shown most clearly in FIG. 6, the visor 24 can be deformed around a fore-and-aft axis A to produce a cylindrical shape. The visor 24 is shown formed around the axis A so that it extends through at least 360°. However, it is not necessary that the deformed visor 24 extend continuously through that extent.

Figure 6:
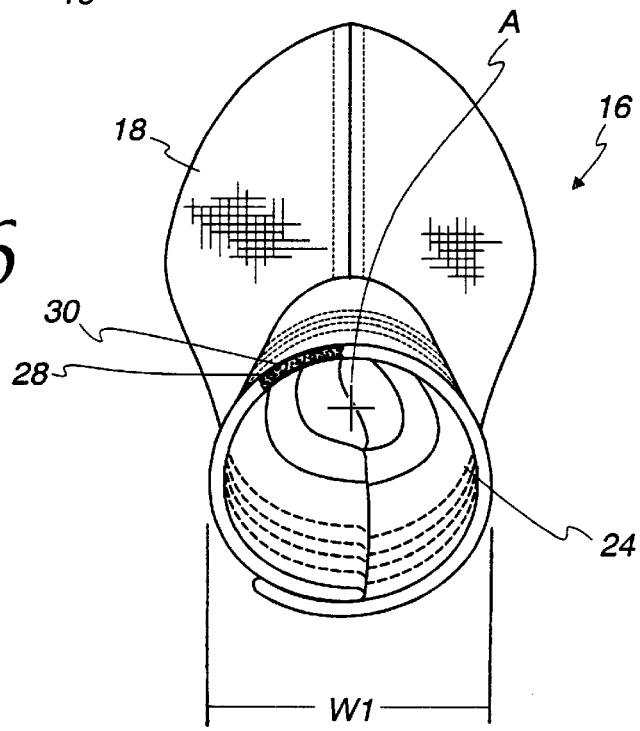
FIG. 6 is an enlarged, front elevation view of the headwear piece in the FIG. 5 state.

With the visor 24 reconfigured to the deformed state of FIG. 6, the crown 18 can be collapsed to reside substantially within a cylinder defined by the deformed visor 24. The collapsing of the crown 18 can be accomplished in a number of different ways.

Figure 5:
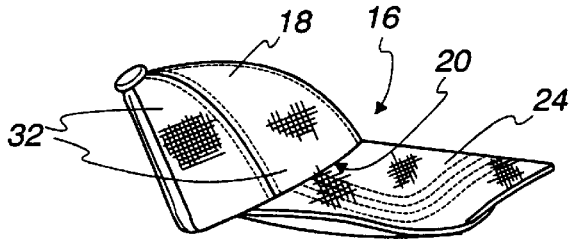
FIG. 5 is a side elevation view of the headwear piece in FIG. 4 with the visor deformed to compact the headwear piece.

In one form, the crown 18 can be compacted to a cylindrical shape while retaining its fore and aft dimension Y (FIG. 3). Alternatively, the crown can be folded in half from front to rear, as shown in FIGS. 4 and 5, to reduce the fore and aft dimension of the crown to approximately one-half the dimension Y before reconfiguring the visor 24. Folding to produce other than this precise dimension is also contemplated. By then placing the visor 24 in the deformed state, the fore and aft dimension of the resulting cylindrical shape for the headwear piece 16 can be significantly reduced.

Figure 7:
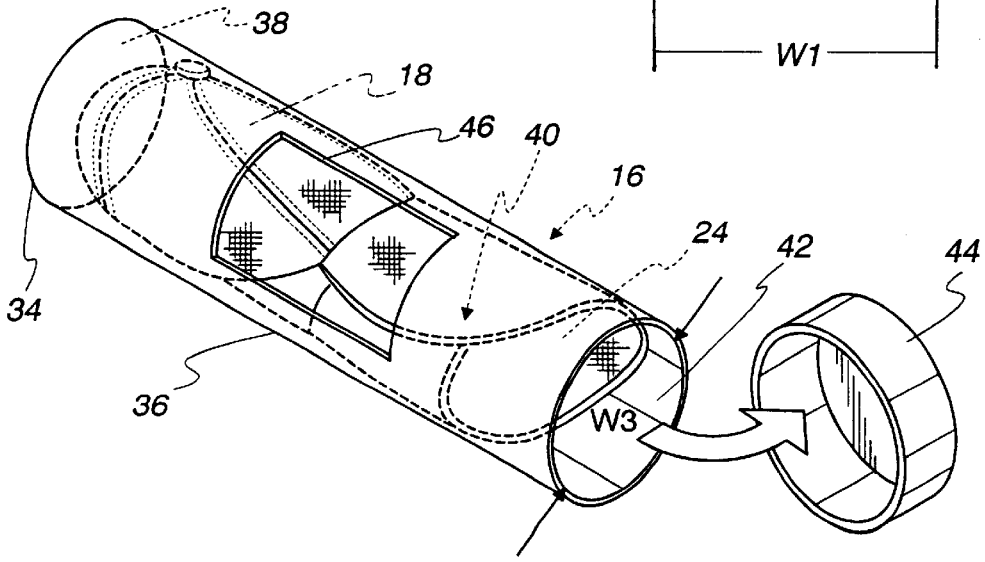
FIG. 7 is a perspective view of a holding element for the headwear piece in the FIG. 5 state and consisting of a cylindrical tube with a removable closure element shown separated therefrom.

Regardless of the reconfiguration of the crown 18, once the visor 24 is reconfigured to the deformed state, the invention contemplates the use of at least one holding element to maintain this state. In FIG. 7, the holding element is in the form of a cylindrical tube 34. The tube 34 has a peripheral wall 36 and an end wall 38 which cooperatively bound an internal storage space 40. The storage space 40 has a diameter W3 that is on the order of the dimension W1, shown in FIG. 6. An opening 42 at the end of the tube 34 opposite the end wall 38 permits the headwear piece 16 in the FIG. 6 state to be introduced into the space 40 and withdrawn therefrom. The opening 42 can be closed by a removable cap 44 which preferably cooperates with the tube 34 so that the tube 34 and cap 44 reside, one within the other, with the cap 44 in the closed state.

Accordingly, the resulting combination of the tube 34 and headwear piece 16 produces a unique package configuration as for point of purchase display. The peripheral wall 36 may be translucent or transparent to allow viewing of the headwear piece 16 therethrough within the storage space 40. Optionally, one or more cutouts 46 may be provided in the peripheral wall 36 to facilitate viewing therethrough of the headwear piece 16 in a storage state within the space 40.

Figure 8:
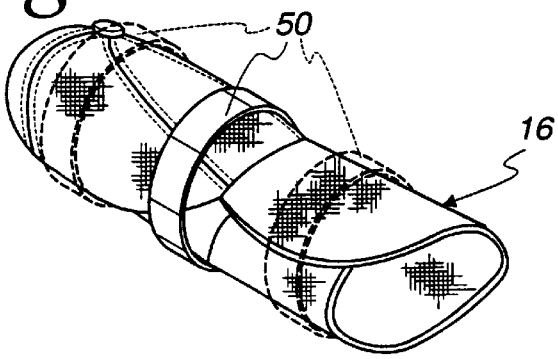
FIG. 8 is a side elevation view of the headwear piece in the FIG. 5 state with a holding element in the form of a band/tubular body extended around the headwear piece.
Figure 9:
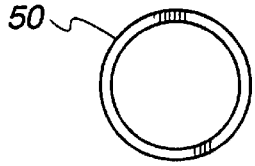
FIG. 9 is an end elevation view of the band/tubular element in FIG. 8.

As an alternative to the cylindrical tube, the holding element may be in the form of a tubular body or band 50, as shown in FIGS. 8 and 9. The tubular body 50 again is dimensioned to fully surround the headwear piece 16 and may be located around the crown 18 to maintain the crown in the previously described deformed state. Multiple holding elements in the form of the tubular body/band 50 may be utilized, as shown in dotted lines in FIG. 8. With this arrangement, a similarly unique, generally cylindrical package is presented consisting of the headwear piece 16 and the holding element 50. The material making up the holding element may be either elastic or have a fixed dimension.

Figure 10:
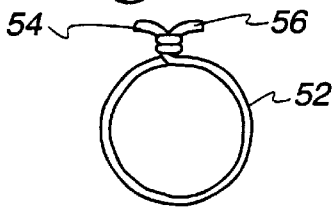
FIG. 10 is an end elevation view of a modified form of band/tubular element consisting of a string-type material which can be tied around the headwear piece.

In FIG. 10, a modified form of band 52 is shown to function as the band 50. The band 52 is in the form of a string material having ends 54, 56 that can be tied together to maintain a constricted diameter around the deformed visor 24.

Figure 11:
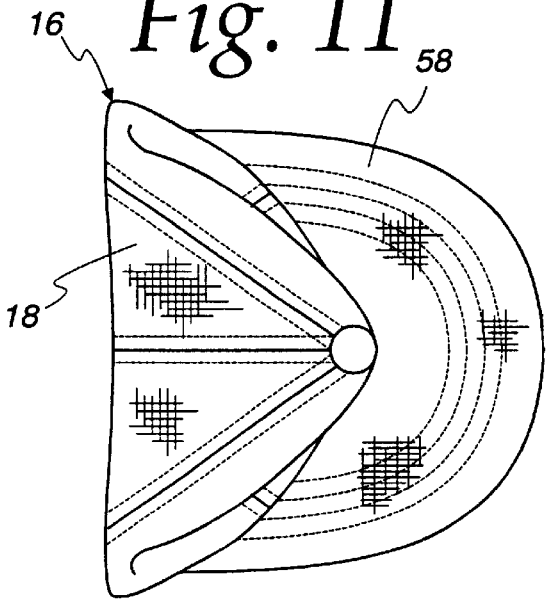
FIG. 11 is a view as in FIG. 4 with the crown folded additionally against the visor before the visor is placed in the deformed state corresponding to that in FIG. 5.

In FIG. 11, a further folding modification to the crown 18 on the headwear piece 22 is shown. After the crown 18 is folded to the FIG. 4 state, the doubled-over crown 18 can be folded once more against the underside 58 of the visor 24 prior to placing the visor 24 in the deformed state. This additional folding step further reduces the fore and aft dimension of the headwear piece 16.

Figure 12:
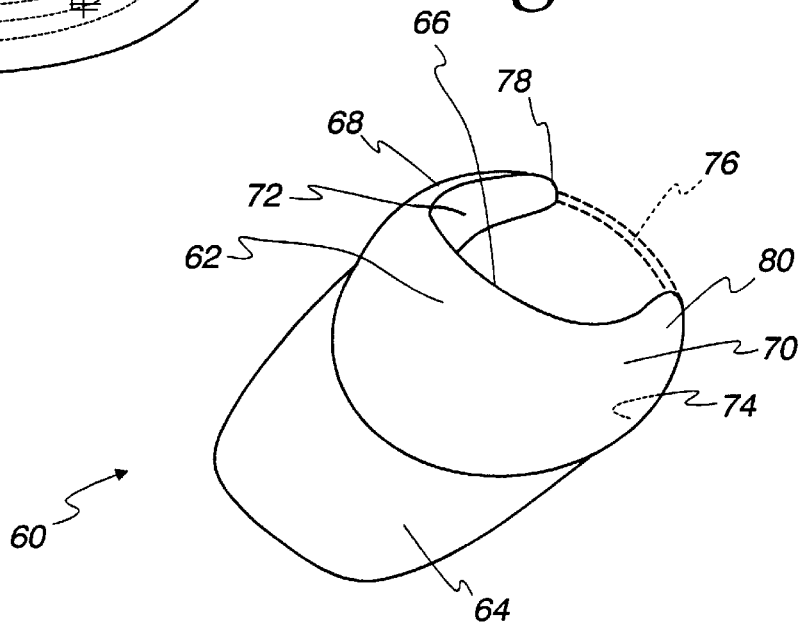
FIG. 12 is a front perspective view of a modified form of headwear piece with which the present invention can be practiced.

In FIG. 12, a further modified form of headwear piece, with which the present invention can be practiced, is shown at 60. The headwear piece 60 has a crown 62 with a visor 64 projecting angularly forwardly therefrom. The headwear piece 60 is generally referred to in its entirety as a visor and has an open region 66 at the top of the headwear piece 60. Two lateral crown portions 68, 70 define surfaces 72, 74 which are grippingly engageable with a wearer's head to maintain the headwear piece 60 thereon. An optional back portion 76 may connect the crown parts 68, 70. Alternatively, the gap may be maintained between the rear ends 78, 80 of the crown parts 68, 70.

The foregoing disclosure of specific embodiments is intended to be illustrative of the broad concepts comprehended by the invention.

I claim:

1. In combination:

a) a headwear piece having a front and rear and comprising a crown having a surface which is grippingly engageable with a wearer's head and a visor of sufficiently rigid material to be shape retentive and readily reducible to a compact state, said visor projecting in a forward direction away from the crown, wherein the visor has a relaxed state wherein the visor has a first width dimension taken transversely to a fore-and-aft line and a deformed state, wherein the visor in the deformed state has a second width dimension taken transversely to the fore-and-aft line that is less than the first width dimension, the visor changed from the relaxed state into the deformed state by bending the visor around the fore-and-aft line towards a continuous cylindrical shape; and b) at least one holding element that is fully separable from the headwear piece, the at least one holding element maintaining the visor in the deformed state so that the visor has the second width dimension, wherein a part of the crown is folded forwardly toward the visor.

2. The combination according to claim 1 wherein the at least one holding element comprises a continuous band which extends around the headwear piece.

3. The combination according to claim 1 wherein the at least one holding element comprises a band which has first and second parts which are joinable to extend around the headwear piece.

4. The combination according to claim 3 wherein the band comprises a string material.

5. The combination according to claim 1 wherein the visor comprises a foam layer.

6. The combination according to claim 1 wherein with the visor in the deformed state the visor defines a cylindrical shape.

7. The combination according to claim 6 wherein with the visor in the deformed state the visor is doubled against itself to extend through 360°.

8. The combination according to claim 1 wherein the crown is folded against itself.

9. The combination according to claim 1 wherein the crown is folded against the visor.

10. The combination according to claim 1 wherein the crown is folded against itself and the visor.

11. The combination according to claim 1 wherein the crown has a closed, cup shape.

12. The combination according to claim 1 wherein the crown comprises a head engaging portion extending through 360°.

13. The combination according to claim 1 wherein the crown comprises a head engaging portion which extends through less than 360°.

14. The combination according to claim 1 wherein the crown has a continuous shape that extends around a wearer's head with the headwear piece worn by a wearer.

15. The combination according to claim 1 wherein the crown has an inverted cup shape.

16. In combination:

a) a headwear piece having a front and rear and comprising a crown having a surface which is grippingly engageable with a wearer's head and a visor of sufficiently rigid material to be shape retentive and readily reducible to a compact state, said visor projecting in a forward direction away from the crown, wherein the visor has a relaxed state wherein the visor has a first width dimension taken transversely to a fore-and-aft line and a deformed state, wherein the visor in the deformed state has a second width dimension that is less than the first width dimension, the visor changed from the relaxed state into the deformed state by bending the visor around the fore-and-aft line towards a continuous cylindrical shape; and b) at least one holding element, the at least one holding element maintaining the visor in the deformed state so that the visor has the second width dimension, wherein the at least one holding element comprises a tubular body which extends around the headwear piece.

17. In combination:

a) a headwear piece having a front and rear and comprising a crown having a surface which is grippingly engageable with a wearers head and a visor of sufficiently rigid material to be shape retentive and readily reducible to a compact state, said visor projecting in a forward direction away from the crown, wherein the visor has a relaxed state wherein the visor has a first width dimension taken transversely to a fore-and-aft line and a deformed state, wherein the visor in the deformed state has a second width dimension that is less than the first width dimension, the visor changed from the relaxed state into the deformed state by bending the visor around the fore-and-aft line towards a continuous cylindrical shape; and b) at least one holding element, the at least one holding element maintaining the visor in the deformed state so that the visor has the second width dimension, wherein the at least one holding element comprises a cylindrical tube.

18. The combination according to claim 17 wherein the cylindrical tube defines a storage space for the headwear piece and comprises an open end through which the headwear piece can be introduced into the storage space and removed from the storage space and a removable cap for selectively blocking the open end.

19. The combination according to claim 17 wherein the cylindrical tube has a peripheral wall through which the headwear piece in the storage space can be viewed.

20. In combination:

a) a headwear piece having a front and rear and comprising a crown having a surface which is grippingly engageable with a wearer's head and a visor of sufficiently rigid material to be shape retentive and readily reducible to a compact state, said visor projecting in a forward direction away from the crown, wherein the visor has a relaxed state wherein the visor has a first width dimension taken transversely to a fore-and-aft line and a deformed state, wherein the visor in the deformed state has a second width dimension that is less than the first width dimension, the visor changed from the relaxed state into the deformed state by bending the visor around the fore-and-aft line towards a continuous cylindrical shape; and b) at least one holding element, the at least one holding element maintaining the visor in the deformed state so that the visor has the second width dimension, wherein the crown is folded against the visor, wherein the visor in the deformed states defines a cylindrical shape and at least a part of the crown that is folded against the visor resides within the cylindrical shape.

21. The combination according to claim 20 wherein the crown has a continuous shape that extends around a wearer's head with the headwear piece worn by a wearer.

22. The combination according to claim 20 wherein the crown has an inverted cup shape.

23. In combination:

a) a headwear piece comprising a crown with a surface which is grippingly engageable with a wearer's head and a visor of sufficiently rigid material to be shape retentive and readily reducible to a compact state, said visor projecting from the crown, wherein the visor has a deformed state and a relaxed state, the visor changed from the relaxed state into the deformed state by bending the visor around a fore-and-aft line towards a continuous cylindrical shape; and b) at least one holding element that is fully separable from the headwear piece, the at least one holding element maintaining the visor in the deformed state.

24. The combination according to claim 23 wherein with the visor in the deformed state the cylindrical shape extends through 360°.

25. The combination according to claim 23 wherein the visor comprises a foam layer.

26. The combination according to claim 23 wherein the at least one holding element extends through 360° around the headwear piece.

27. The combination according to claim 23 wherein the crown has a continuous shape that extends around a wearer's head with the headwear piece worn by a wearer.

28. The combination according to claim 23 wherein the crown has an inverted cup shape.

29. In combination:

a) a headwear piece comprising a crown with a surface which is grippingly engageable with a wearer's head and a visor of sufficiently rigid material to be shape retentive and readily reducible to a compact state, said visor projecting from the crown, wherein the visor has a deformed state and a relaxed state, the visor changed from the relaxed state into the deformed state by bending the visor around a fore-and-aft line towards a continuous cylindrical shape; and b) at least one holding element that is fully separable from the headwear piece, the at least one holding element maintaining the visor in the deformed state, wherein the at least one holding element comprises a tubular body which extends around the headwear piece.

30. In combination:

a) a headwear piece comprising a crown with a surface which is grippingly engageable with a wearer's head and a visor of sufficiently rigid material to be shape retentive and readily reducible to a compact state, said visor projecting from the crown, wherein the visor has a deformed state and a relaxed state, the visor changed from the relaxed state into the deformed state by bending the visor around a fore-and-aft line towards a continuous cylindrical shape; and b) at least one holding element, the at least one holding element maintaining the visor in the deformed state, wherein the at least one holding element comprises a tubular body which extends around the headwear piece.

* * * * *

US006507956C1

(12) INTER PARTES REEXAMINATION CERTIFICATE (0078th)

United States Patent

Kronenbeger

(10) Number: US 6,507,956 C1

(45) Certificate Issued: Jul. 14, 2009

(54) HEADWEAR PACKAGING SYSTEM

(75) Inventor: Ronald Kronenbeger, Riverwoods, IL (US)

(73) Assignee: Cooperstown Bears, Ltd., Buffalo Grove, IL (US)

Reexamination Request:
No. 95/000,081, Mar. 3, 2005

Reexamination Certificate for:

| | |
|---|---|
| Patent No.: | **6,507,956** |
| Issued: | **Jan. 21, 2003** |
| Appl. No.: | **09/723,030** |
| Filed: | **Nov. 27, 2000** |

(51) Int. Cl.
*A42B 1/00* (2006.01)

(52) U.S. Cl. ..... 2/195.1; 2/209.13

(58) Field of Classification Search ..... None
See application file for complete search history.

(56) References Cited

U.S. PATENT DOCUMENTS

| | | | | | |
|---|---|---|---|---|---|
| 2,772,811 | A | * | 12/1956 | Schaef | 221/155 |
| 5,533,652 | A | * | 7/1996 | Levin | 223/84 |
| 5,593,029 | A | * | 1/1997 | Both | 206/278 |
| 5,634,575 | A | * | 6/1997 | Scharrenberg | 223/84 |
| 5,813,538 | A | * | 9/1998 | Kaufman | 206/457 |
| 5,924,596 | A | * | 7/1999 | Kaufman | 221/312 C |
| 5,991,927 | A | * | 11/1999 | Barbaccia | 2/209.13 |
| 6,149,955 | A | * | 11/2000 | Wilson | 426/112 |

FOREIGN PATENT DOCUMENTS

WO WO 98/02355 * 1/1998

OTHER PUBLICATIONS

How To: Curl a Hat Brim, The Harvard Crimson Online, Mar. 11, 1999.*

* cited by examiner

*Primary Examiner*—Glenn K. Dawson

(57) ABSTRACT

The combination of a headwear piece and at least one holding element. The headwear piece has a front and rear and consists of a crown with a surface which is grippingly engageable with a wearer's head and a visor projecting in a forward direction away from the crown. The visor has a relaxed state, wherein the visor has a first width dimension taken transversely to a fore-and-aft line, and a deformed state. With the visor in the deformed state, the visor has a second width dimension that is less than the first width dimension. The at least one holding element maintains the visor in the deformed state in which the visor has the second width dimension.

At the time of issuance and publication of this certificate, the patent remains subject to pending reissue application number 11/035,428 filed Jan. 13, 2005. The claim content of the patent may be subsequently revised if a reissue patent is issued from the reissue application.

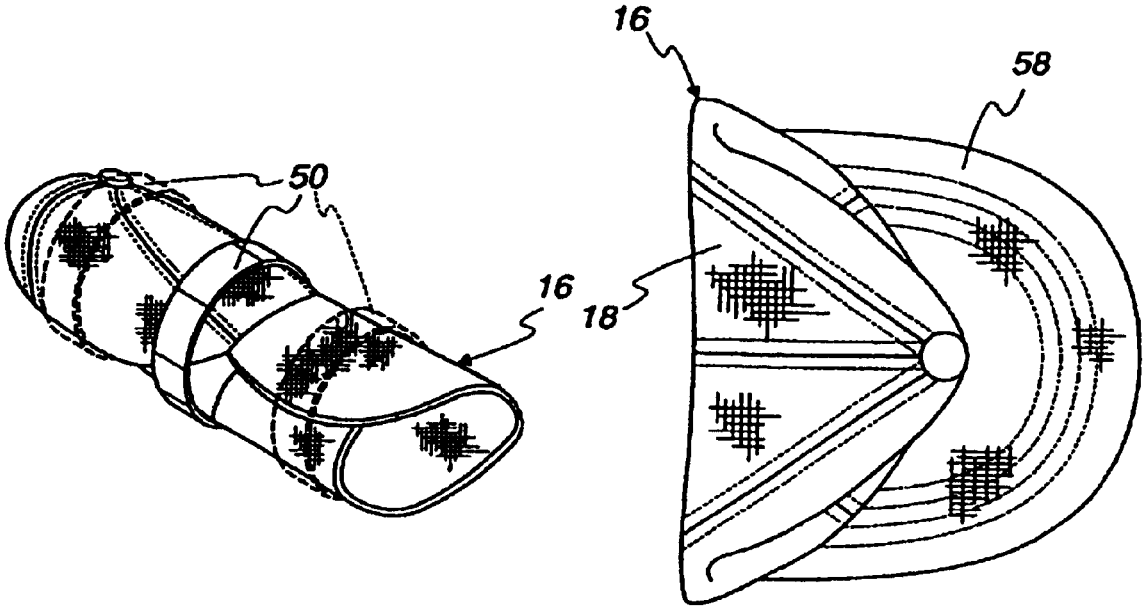

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 38–49:

As an alternative to the cylindrical tube, the holding element may be in the form of a tubular body or band 50, as shown in FIGS. 8 and 9, *that extends in a generally circular shape around the headwear piece*. The tubular body 50 again is dimensioned to fully surround the headwear piece 16 and may be located around the crown 18 to maintain the crown in the previously described deformed state. Multiple holding elements in the form of the tubular body/band 50 may be utilized, as shown in dotted lines in FIG. 8. With this arrangement, a similarly unique, generally cylindrical package is presented consisting of the headwear piece 16 and the holding element 50. The material making up the holding element may be either elastic or have a fixed dimension.

AS A RESULT OF REEXAMINATION, IT HAS BEEN DETERMINED THAT:

Claims 1–30 are cancelled.

* * * * *